United States Patent [19]

Schneider

[11] 4,139,882

[45] Feb. 13, 1979

[54] BATHROOM CABINET

[76] Inventor: Walter Schneider, 54 Wildenbühlstrasse, Langnau am Albis, (Kt. Zurich), Switzerland

[21] Appl. No.: 788,765

[22] Filed: Apr. 19, 1977

[30] Foreign Application Priority Data

Apr. 23, 1976 [CH] Switzerland ..... 5104/76

[51] Int. Cl.[2] ..... F21V 33/00

[52] U.S. Cl. ..... 362/260; 362/365

[58] Field of Search ..... 362/260, 365

[56] References Cited

U.S. PATENT DOCUMENTS

| | | | |
|---|---|---|---|
| 2,336,414 | 12/1943 | Mitchell | 362/260 |
| 2,620,580 | 12/1952 | Dwinell | 362/260 |
| 3,081,397 | 3/1963 | Tantillo et al. | 362/260 |
| 3,794,830 | 2/1974 | Hitzler | 362/260 |

*Primary Examiner*—Edward A. Miller

*Attorney, Agent, or Firm*—William Anthony Drucker

[57] ABSTRACT

A bathroom cabinet comprising an illuminated shelf, in which internal side walls of the illuminated shelf are each provided with a bracket, the side walls of the illuminating shelf being provided with recesses in which pins engage, while each of the brackets comprises on the inside two guide ribs, and in which a fluorescent body is mounted on an assembly part, which is inserted, with two legs of its U-section, between the guide ribs, and in which the brackets are provided with resilient tongues, on which a translucent bowl, which shields the fluorescent body, is placed in a frictionally gripping manner.

4 Claims, 4 Drawing Figures

BATHROOM CABINET

Figure 1:
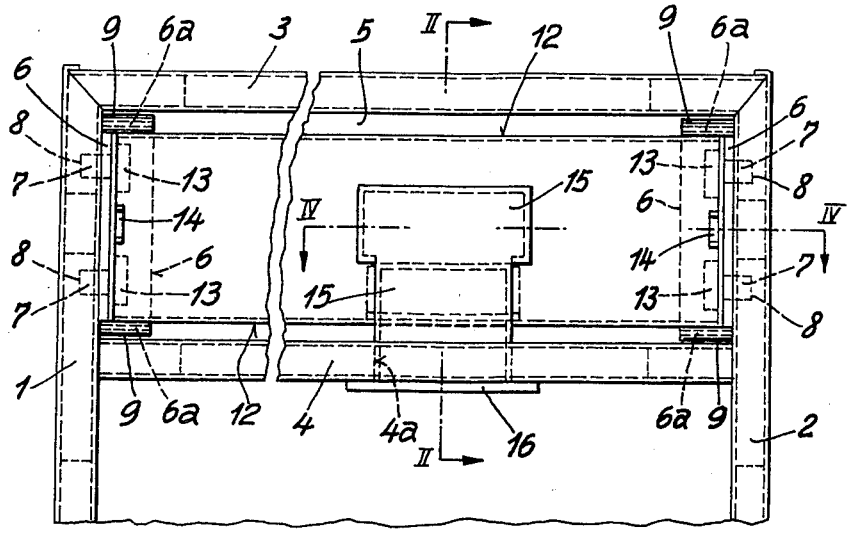

The present invention relates to a bathroom cabinet which comprises an illuminated shelf and differs from known bathroom cabinets in that each of the internal side walls of the illuminated shelf is lined with a bracket in an electrically insulating material, the side walls of the illuminated shelf being provided with recesses in which pins, which project from the outside of the bracket, engage in a form-locking manner, while each of the brackets is provided on the inside with two guide ribs, and in that the light-emitting body or bodies and the associated auxiliary units are mounted on an assembly part which is channel-shaped in cross section and is inserted, with the two legs of its U-section in advance, between the guide ribs of the insulating brackets, and in that furthermore the brackets are provided with resilient tongues which extend beyond the web of the U-section and on which a translucent bowl, which shields the light-emitting body or bodies, is placed with a frictional grip.

The design according to the invention ensures a satisfactory insulation of the assembly part with respect to the bathroom cabinet. The fact that the assembly part can be equipped with the fluorescent tubes or bulbs as well as with the associated auxiliary equipment away from the bathroom cabinet and that the brackets and the assembly part can be fitted quickly and easily to the bathroom cabinet without any tools is also of special advantage.

Figure 2:
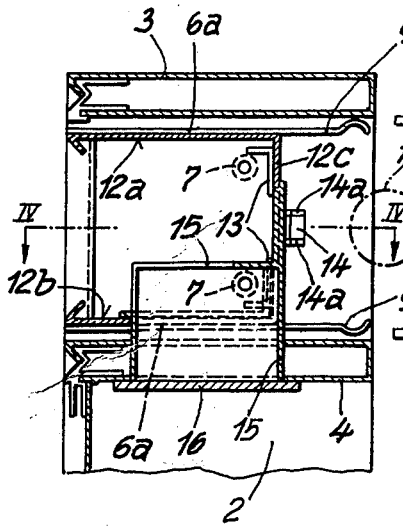
Figure 3:
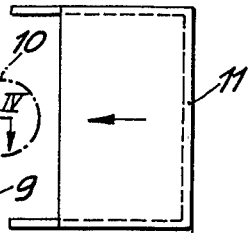
Figure 4:
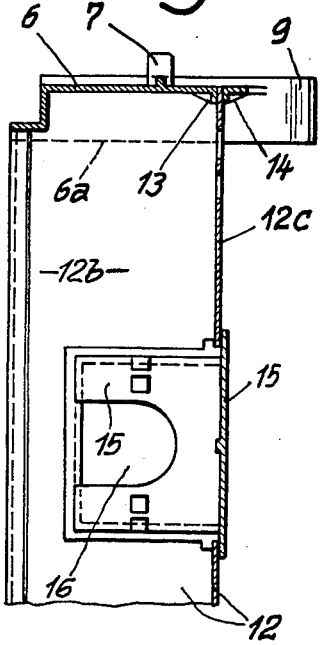

An embodiment of the object of the invention is shown by way of example in the drawing, in which:

FIG. 1 is a front view of the upper portion of a bathroom cabinet with the illuminated shelf, FIG. 2 is a cross section along the line II—II shown in FIG. 1, FIG. 3 shows the bowl serving to shield the light-emitting body, and FIG. 4 shows a horizontal section along the line IV—IV of FIG. 2.

In the example shown, 1 and 2 designate the two side walls of the bathroom cabinet which, together with the cabinet cover 3 and an intermediate base 4, bound the illuminated shelf 5. Each of the internal side walls of the illuminated shelf is lined with a bracket 6 in an electrically insulating material. These brackets are provided with pins 7 which project on the outside thereof and engage in recesses 8 of the side walls 1, 2 in a form-locking manner and thus fix the brackets in the position shown. The brackets 6 are provided with resilient tongues 9, on which the translucent bowl 11, which shields the fluorescent tube 10, can be placed with a frictional grip. On the inside, each of the brackets 6 is provided with two guide ribs 6*a*.

Designated by 12 is an assembly part which is channel-shaped in cross section and is made of sheet-metal and on which the fluorescent tube 10 is mounted together with the associated auxiliary equipment, such as sockets, cables, terminals, ballast etc. The assembly part 12 is inserted, with the legs 12*a* and 12*b* of its U-section in advance, between the ribs 6*a* of the bracket 6. Two stops 13, which are fitted on each bracket and against which the channel web 12*c* of the assembly part rests when the part is inserted in the illuminating shelf, serve for fixing the built-in part in the position shown in FIG. 2. A detent 14, which is arranged on the bracket and is provided with oblique surfaces 14*a*, ascending in the direction of the channel web 12*c*, is mounted forward of the stops 13 at a distance that corresponds approximately to the sheet-metal thickness of the web 12*c*.

The lower leg 12*b* as well as the web 12*c* of the assembly part 12 are provided with openings in which a cladding 15, which contains an electric socket and is made of an electrically insulating material, is inserted in a form-locking manner. This cladding also penetrates the intermediate base 4 in a hole 4*a*, the cladding and socket being covered beneath the intermediate base 4 by a cover plate 16.

During the installation of the illuminating unit, first the brackets 6 are secured to the internal walls of the illuminating shelf 5 by plugging of the pins 7 into the recesses 8, whereafter the assembly part 12, which is equipped with the fluorescent tube 10 and the associated auxiliary units, is pushed, with the legs 12*a*, 12*b*, in advance, between the ribs 6*a* of the brackets 6 until the web 12*c* of the assembly part 12 clicks into the gap between the detent 14 and the stops 13. All these manipulations can be performed quickly and without difficulty and without the aid of any tools.

I claim:

1. A bathroom cabinet having an illuminated shelf comprising:

(a) a pair of oppositely disposed side walls of the cabinet, each having internal and external faces;

(b) means defining recesses formed in the internal faces of said side walls;

(c) a pair of brackets formed of an electrically insulating material;

(d) pins formed on said brackets and engaged in form-locking manner in said recesses thereby to hold said brackets against said side walls;

(e) guide ribs formed on the internal faces of said brackets;

(f) a lighting assembly including a lighting assembly support which is channel-shaped in cross section having a pair of spaced parallel leg portions and a connecting web portion, the ends of said leg portions being engaged by said guide ribs;

(g) resilient tongues formed on said brackets and extending beyond said web portion; and (h) a translucent lighting assembly cover frictionally held by said resilient tongues in a position covering the lighting assembly.

2. A bathroom cabinet according to claim 1, further comprising stops formed on the inside faces of said brackets, against which stops the ends of said connecting web portion rest.

3. A bathroom cabinet according to claim 2, further comprising detents formed on the inside faces of said brackets and spaced from said stops by a distance approximately equal to the thickness of said connecting web portion, the ends of said connecting web portion being held between said stops and said detents.

4. A bathroom cabinet according to claim 1, further including means defining a further recess in the lower leg portion and the connecting web of said lighting assembly support, and a cladding formed of electrically insulating material and containing electrical socket means of the lighting assembly being inserted in form locking manner in said further recess.

* * * * *